US010472693B2

(12) United States Patent
Kijima et al.

(10) Patent No.: US 10,472,693 B2
(45) Date of Patent: Nov. 12, 2019

(54) HEAD HARDENED RAIL MANUFACTURING METHOD AND MANUFACTURING APPARATUS

(71) Applicant: JFE STEEL CORPORATION, Tokyo (JP)

(72) Inventors: Hideo Kijima, Tokyo (JP); Hiroyuki Fukuda, Tokyo (JP); Kenji Okushiro, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 364 days.

(21) Appl. No.: 15/503,361

(22) PCT Filed: Aug. 19, 2015

(86) PCT No.: PCT/JP2015/004135
§ 371 (c)(1),
(2) Date: Feb. 10, 2017

(87) PCT Pub. No.: WO2016/027467
PCT Pub. Date: Feb. 25, 2016

(65) Prior Publication Data

US 2017/0233843 A1 Aug. 17, 2017

(30) Foreign Application Priority Data

Aug. 20, 2014 (JP) ..... 2014-167432

(51) Int. Cl.

| | |
|---|---|
| ***C21D 9/00*** | (2006.01) |
| ***E01B 5/02*** | (2006.01) |
| ***C22C 38/04*** | (2006.01) |
| ***C22C 38/02*** | (2006.01) |
| ***C21D 9/04*** | (2006.01) |
| ***C22C 38/24*** | (2006.01) |

(52) U.S. Cl.
CPC ..... *C21D 9/0062* (2013.01); *C21D 9/04* (2013.01); *C22C 38/02* (2013.01); *C22C 38/04* (2013.01); *C22C 38/24* (2013.01); *E01B 5/02* (2013.01); *C21D 2211/009* (2013.01)

(58) Field of Classification Search
CPC .. C21D 2211/009; C21D 8/00; C21D 9/0062; C21D 9/04; C22C 38/00; C22C 38/02; C22C 38/04; C22C 38/24; E01B 5/02
See application file for complete search history.

(56) References Cited

U.S. PATENT DOCUMENTS

| | | | |
|---|---|---|---|
| 4,714,500 | A | 12/1987 | Heller et al. |
| 5,658,400 | A | 8/1997 | Uchino et al. |
| 2010/0116381 | A1 | 5/2010 | Honjo et al. |
| 2013/0065079 | A1 | 3/2013 | Ueda et al. |

FOREIGN PATENT DOCUMENTS

| | | | | |
|---|---|---|---|---|
| CN | 1 118 174 | A | 3/1996 | |
| CN | 101646795 | A | 2/2010 | |
| EP | 0187904 | A2 * | 7/1986 | ..... C21D 9/04 |
| EP | 0187904 | A2 | 7/1986 | |
| JP | S55-002768 | A | 1/1980 | |
| JP | H06-340951 | A | 12/1994 | |
| JP | H07-173530 | A | 7/1995 | |
| JP | 11152521 | A * | 6/1999 | |
| JP | H11-152521 | A | 6/1999 | |
| JP | 2005-146346 | A | 6/2005 | |
| JP | 2005-171327 | A | 6/2005 | |
| JP | 2005146346 | A * | 6/2005 | |
| JP | 2005171327 | A * | 6/2005 | |
| JP | 3950212 | B2 | 7/2007 | |
| JP | 2008-050687 | A | 3/2008 | |
| JP | 2009-108397 | A | 5/2009 | |
| JP | 2010-100937 | A | 5/2010 | |
| JP | 2010-180443 | A | 8/2010 | |
| JP | 2010255046 | A | 11/2010 | |
| JP | 5391711 | B2 | 1/2014 | |
| WO | 2011/155481 | A1 | 12/2011 | |

OTHER PUBLICATIONS

Aug. 22, 2017 Office Action issued in Japanese Patent Application No. 2016-543821.
Nov. 1, 2017 Office Action issued in Chinese Patent Application No. 201580044712.6.
Jun. 10, 2015 Written Opinion issued in International Patent Application No. PCT/JP2015/004135.
Oct. 6, 2015 Search Report issued in International Patent Application No. PCT/JP2015/004135.
Jul. 13, 2017 Extended Search Report issued in European Patent Application No. 15833397.1.

* cited by examiner

*Primary Examiner* — Jenny R Wu
(74) *Attorney, Agent, or Firm* — Oliff PLC

(57) ABSTRACT

A manufacturing method and a manufacturing apparatus for a head hardened rail to which various alloy elements are added and which is excellent in hardness and toughness of a head portion surface layer. The method includes, when forcibly cooling at least a head portion of a hot-rolled rail or a heated rail, starting the forcible cooling from a state where a surface temperature of the head portion of the rail is not less than an austenite range temperature, and performing the forcible cooling at a cooling rate of 10° C./sec or more until the surface temperature reaches 500° C. or more and 700° C. or less after the forcible cooling is started.

5 Claims, 1 Drawing Sheet

HEAD HARDENED RAIL MANUFACTURING METHOD AND MANUFACTURING APPARATUS

TECHNICAL FIELD

The present invention relates to a manufacturing method and a manufacturing apparatus for a head hardened rail in which a hot-rolled high-temperature rail or a rail heated at a high temperature is forcibly cooled by using a cooling medium such as air, water or mist, thereby forming a head portion of the rail into a fine pearlite structure.

BACKGROUND ART

Among rails for use in railways and the like, for example, the rail for use under a strict environment such as a stope of natural resources such as coals is required to have a high wear resistance and a high toughness. Such a rail has the high wear resistance, the high toughness and a high hardness because a structure of a rail head portion consists of a fine pearlite structure. The rail in which the structure of the head portion consists of the fine pearlite structure is usually manufactured by using the following manufacturing method.

First, a hot-rolled rail at a temperature that is not less than an austenite range temperature or a rail heated at the temperature that is not less than the austenite range temperature is conveyed into a heat treatment apparatus in an upright state. Here, the upright state refers to a state where the head portion of the rail is disposed upward and an underside of foot portion thereof is disposed downward. When the rail is conveyed into the heat treatment apparatus, for example, there is a case where the rail which remains in a rolled length of about 100 m is conveyed into the heat treatment apparatus or a case where the rail is cut into rails so that a length per rail is, for example, about 25 m (hereinafter also referred to as sawing), and then conveyed into the heat treatment apparatus. It is to be noted that in the case where the rail is sawn and then conveyed into the heat treatment apparatus, the heat treatment apparatus might be divided into zones each having a length corresponding to the sawn rail.

Next, in the heat treatment apparatus, toe tip portions of the rail are bound with clamps, and a rail head top portion, head side portions, the underside of foot portion and further a web portion as required are forcibly cooled by using a cooling medium. In the cooling medium, air, water, mist or the like is used. In such a manufacturing method of the rail, a cooling rate during the forcible cooling is controlled, whereby the whole head portion including an inner region of the rail can be formed into the fine pearlite structure. Furthermore, when forcibly cooling the rail, the cooling is performed until a temperature of the head portion of the rail reaches a range of about 350° C. to 450° C.

Furthermore, the rail bound with the clamps is released, and the rail is conveyed to a cooling bed. The rail conveyed to the cooling bed is cooled to about room temperature.

As for structure of the rail head portion, bainite is poor in wear resistance and martensite is poor in toughness. Therefore, it is difficult to simultaneously achieve a high wear resistance and a high toughness, and hence the whole head portion needs to have the pearlite structure. Furthermore, as lamella spacing of the pearlite structure is finer, both the wear resistance and the toughness improve, and hence the structure of the rail head portion needs to have the fine lamella spacing. For the purpose of obtaining the pearlite structure at the fine lamella spacing, it is important to set the cooling rate during the forcible cooling.

For example, in PTL 1, there is disclosed a method of manufacturing a pearlite-based rail containing, in terms of mass %, C: 0.65 to 1.2%, Si: 0.05 to 2.00%, and Mn: 0.05 to 2.00% and the remainder comprising Fe and inevitable impurities, and in the method, a rolling temperature and a head portion cumulative area reduction ratio are defined, and then accelerated cooling or natural radiation cooling of a rail head portion surface is performed down to at least 550° C. at a cooling rate of 2 to 30° C./sec.

Furthermore, in PTL 2, there is disclosed a method of rapidly cooling, down to 450 to 680° C. at a cooling rate of 2 to 20° C./sec, a rail head portion surface having a temperature of an $A_3$ or Acm ray to 1000° C. in a hot-rolled rail containing, in terms of mass %, C: 0.60 to 1.20%, Si: 0.05 to 2.00%, and Mn: 0.05 to 2.00% and the remainder comprising Fe and inevitable impurities, afterward raising the temperature to a temperature range of the $A_3$ or $A_{cm}$ ray to 950° C. at a temperature rise rate of 2 to 50° C./sec, afterward holding the temperature range for 1.0 to 900 sec, and further afterward performing accelerated cooling down to 450 to 650° C. at a cooling rate of 5 to 30° C./sec.

Furthermore, in PTLs 3 and 4, there is disclosed a method of performing cooling from an austenite range to a pearlite transformation temperature of generally about 600° C. at a cooling rate of 30° C./sec or less, holding a surface temperature until pearlite transformation almost finishes, and then performing cooling down to ordinary temperature range by use of a refrigerant as fast as possible.

CITATION LIST

Patent Literature

PTL 1: JP 2008-050687 A
PTL 2: JP 2010-255046 A
PTL 3: JP 5391711
PTL 4: JP 3950212

SUMMARY OF INVENTION

Technical Problem

Additionally, in recent years, various alloy elements have been added to a pearlite-based rail to further improve a hardness of a head portion.

However, in a method disclosed in PTL 1, in a case where an amount of the alloy element to be added increases, a sufficient hardness improvement effect cannot be obtained in a region of a cooling rate range in which a cooling rate is slow.

Furthermore, similarly in a method disclosed in PTL 2, in the case where the amount of the alloy element to be added increases, the sufficient hardness improvement effect cannot be obtained in the region of the cooling rate range in which the cooling rate is slow. Furthermore, in the method disclosed in PTL 2, there has been the problem that a toughness of a surface remarkably deteriorates in a low temperature range of 550° C. or less in a cooling target temperature range.

Furthermore, in methods disclosed in PTLs 3 and 4, hypereutectoid steel having a carbon content of 0.85 mass % or more is defined as a target, but a surface layer hardness can similarly improve also for eutectoid steel. On the other hand, in recent years, improvement of inner hardness and ductility of the rail has become important, but in the methods described in PTLs 3 and 4, it has not been possible to sufficiently improve the inner hardness and ductility of the eutectoid steel.

To eliminate such problems, the present invention has been developed in view of the above problems, and an object thereof is to provide a manufacturing method and a manufacturing apparatus for a head hardened rail to which various alloy elements are added and which is excellent in hardness and toughness of a head portion surface layer.

Solution to Problem

To achieve the above object, a manufacturing method of a head hardened rail according to one aspect of the present invention is characterized by, when forcibly cooling at least a head portion of a hot-rolled high-temperature rail or a heated high-temperature rail, starting the forcible cooling from a state where a surface temperature of the head portion of the rail is not less than an austenite range temperature, and performing the forcible cooling at a cooling rate of 10° C./sec or more until the surface temperature reaches 500° C. or more and 700° C. or less after the forcible cooling is started.

Furthermore, a manufacturing apparatus of a head hardened rail according to one aspect of the present invention includes cooling means for forcibly cooling at least a head portion of the rail, and a control section to control the cooling means, and is characterized in that the control section starts the forcible cooling from a state where a surface temperature of the head portion of the rail is not less than an austenite range temperature, and performs the forcible cooling at a cooling rate of 10° C./sec or more until the surface temperature reaches 500° C. or more and 700° C. or less after the forcible cooling is started.

Advantageous Effects of Invention

According to a manufacturing method of a head hardened rail according to the present invention, it is possible to manufacture the head hardened rail to which various alloy elements are added and which is excellent in hardness and toughness of a head portion surface layer. Furthermore, also for a rail of a component composition of eutectoid steel, it is possible to improve not only hardness and ductility of a head portion surface but also those of a head portion inner region.

DESCRIPTION OF EMBODIMENTS

Configurations to implement the present invention (hereinafter referred to as embodiments) will now be described in detail with reference to the drawings.

<Constitution of Heat Treatment Apparatus>

First, a heat treatment apparatus 2 that is a manufacturing apparatus of a head hardened rail according to one embodiment of the present invention will be described with reference to FIG. 1 and FIG. 2. The heat treatment apparatus 2 is an apparatus to forcibly cool a hot-rolled rail at a temperature that is not less than an austenite range temperature, or a rail heated at the temperature that is not less than the austenite range temperature, and the apparatus is continuously disposed on a downstream side of a hot rolling line or a downstream side of a heating device to heat the rail.

Figure 1:
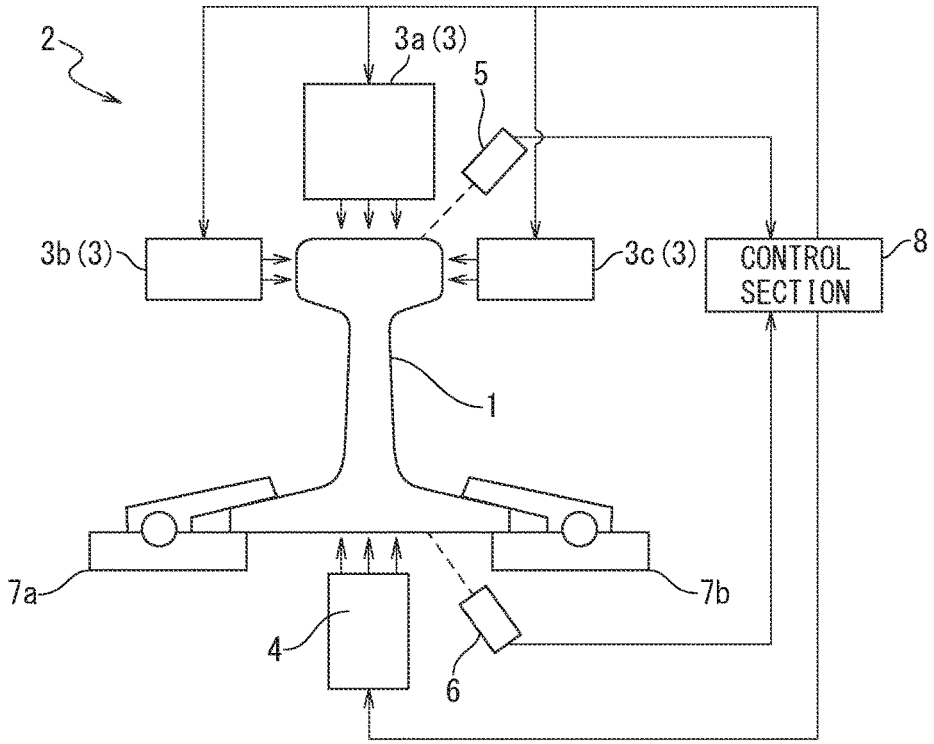
FIG. 1 is a schematic view illustrative of a heat treatment apparatus in one embodiment of the present invention.
Figure 2:
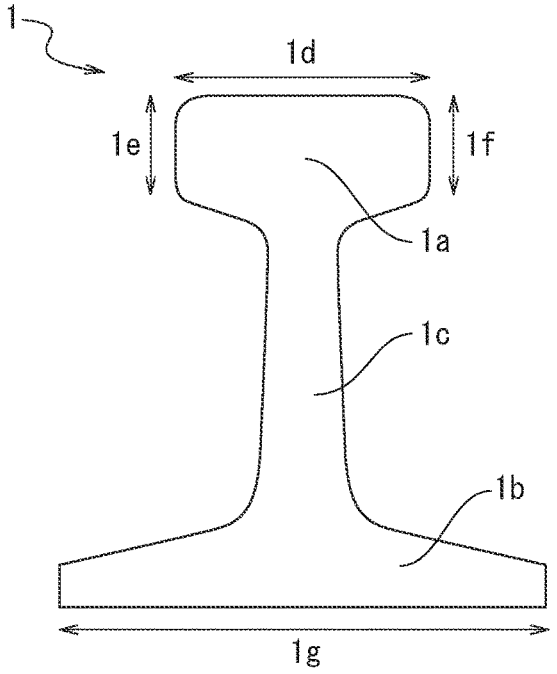
FIG. 2 is a cross-sectional view illustrative of respective regions of a rail.

As illustrated in FIG. 1, the heat treatment apparatus 2 has an upper header 3, a lower header 4, a head portion thermometer 5, a foot portion thermometer 6, clamps 7*a* and 7*b*, and a control section 8. Here, as illustrated in FIG. 1 and FIG. 2, a rail 1 includes a head portion 1*a*, a foot portion 1*b*, and a web portion 1*c*, and is conveyed into the heat treatment apparatus 2 in a state where the head portion 1*a* is disposed upward and the foot portion 1*b* is disposed downward. The head portion 1*a* has a head top face 1*d* that is an upper end face in an upward-downward direction, and head side faces 1*e* and 1*f* which are both end faces facing each other in a right-left direction. Furthermore, the foot portion 1*b* has an underside of foot 1*g* that is a lower end face in the upward-downward direction. It is to be noted that the upward-downward direction is a direction in which the web portion 1*c* extends in a cross-sectional view vertical to a longitudinal direction of the rail 1. Furthermore, the right-left direction is a direction vertical to the upward-downward direction in the cross-sectional view vertical to the longitudinal direction of the rail 1, and is a direction in which the head portion 1*a* and the foot portion 1*b* extend.

The upper header 3 is cooling means for discharging a cooling medium from a plurality of non-illustrated nozzles disposed in one end face to the head portion 1*a* of the rail, thereby mainly cooling the head portion 1*a*, and the upper header is connected to a cooling medium supply device via a non-illustrated pipe. In the cooling medium, air, spray water, mist or the like is used. As illustrated in FIG. 1, the heat treatment apparatus 2 in one embodiment of the present invention has three upper headers 3*a*, 3*b* and 3*c* as the upper header 3 in the cross-sectional view vertical to the longitudinal direction of the rail 1. The upper header 3*a* is disposed so that one end face in which the nozzles are arranged faces the head top face 1*d*, and squirts the cooling medium from the nozzles to cool the head top face 1*d*. The upper headers 3*b* and 3*c* are disposed so that faces in which the nozzles are arranged at one end face the head side faces 1*e* and 1*f*, respectively, and the headers squirts the cooling medium from the nozzles, thereby cooling the head side faces 1*e* and 1*f*, respectively.

The lower header 4 is cooling means for discharging the cooling medium from a plurality of non-illustrated nozzles disposed in one end face to the underside of foot 1*g* of the rail to mainly cool the foot portion 1*b*, and the lower header is connected to the cooling medium supply device via a non-illustrated pipe. In the cooling medium, similarly to the upper header 3, air, spray water, mist or the like is used. The lower header 4 is disposed so that the one end face in which the nozzles are arranged faces the underside of foot 1*g*.

The upper header 3 and the lower header 4 are constituted so that at least one of an amount of the cooling medium to be squirted, a squirt pressure thereof, a temperature thereof, and further a water content thereof in a case where the cooling medium is the mist is changeable. Furthermore, the amount of the cooling medium to be squirted, the squirt pressure, the temperature and the water content are adjusted by the control section 8 as described later. Furthermore, a plurality of upper headers 3 and a plurality of lower headers 4 are arranged in the longitudinal direction of the rail 1 in accordance with a length of the rail 1 in the longitudinal direction.

The head portion thermometer 5 is a non-contact type of thermometer, and measures a surface temperature of at least one region of the head top face 1*d* as the surface temperature of the head portion 1*a*.

The foot portion thermometer 6 is a non-contact type of thermometer similarly to the head portion thermometer 5, and measures a surface temperature of at least one region of the underside of foot 1*g* as the surface temperature of the foot portion 1*b*.

The measurement results in the head portion thermometer 5 and the foot portion thermometer 6 are sent to the control section 8.

The clamps 7*a* and 7*b* are devices which sandwich ends of the foot portion 1*b* in the right-left direction in the cross-sectional view vertical to the longitudinal direction of the rail 1 to fix the rail 1, and pluralities of clamps are arranged in the longitudinal direction of the rail 1, respectively. Consequently, the clamps 7*a* and 7*b* can bind the rail 1 even in a case where the rail 1 has a bend in the longitudinal direction. For example, the clamps 7*a* and 7*b* are arranged in the longitudinal direction of the rail 1 along a total length of the rail 1 at installation intervals each of which is about 5 m.

On the basis of the measurement results of the head portion thermometer 5 and the foot portion thermometer 6, the control section 8 controls the cooling medium supply device described later to change at least one of the amount of the cooling medium to be squirted, the squirt pressure, the temperature and the water content, thereby adjusting a cooling rate and a temperature rise rate of the rail 1. Here, the heat treatment apparatus 2 has the non-illustrated pipes and the cooling medium supply device between the control section 8 and the upper header 3 and the lower header 4. The cooling medium supply device is connected to the upper header 3 and the lower header 4 via pipes, and is constituted so that at least one of an amount of the cooling medium to be squirted on the basis of an instruction of the control section, a squirt pressure thereof, a temperature thereof and a water content thereof is changeable.

<Manufacturing Method of Head Hardened Rail>

Next, a manufacturing method of the head hardened rail according to one embodiment of the present invention will be described. In the manufacturing method of the head hardened rail according to the one embodiment of the present invention, first, the hot-rolled rail 1 or the heated rail 1 is conveyed into the heat treatment apparatus 2. When using the hot-rolled rail 1, a steel material is beforehand heated up to a predetermined temperature in a heating furnace or the like, and then hot-rolled to be rolled and processed in the form of the rail 1. On the other hand, when using the heated rail 1, the rail 1 is beforehand heated up to the predetermined temperature by use of the heating furnace, a heating device or the like. It is to be noted that for the predetermined temperature, in each of the above cases, the surface temperature of the head portion 1*a* is a temperature that is not less than the austenite range temperature at start of forcible cooling in a first cooling step that will be described later.

The rail 1 is steel to which an alloy element is added, and contains Cr as at least an alloy component. Specifically, a component composition of the rail 1 contains, in terms of mass %, C: 0.60% or more and 1.0% or less, Si: 0.1% or more and 1.5% or less, Mn: 0.01% or more and 1.5% or less, P: 0.001% or more and 0.035% or less, S: 0.0005% or more and 0.030% or less, and Cr: 0.1% or more and 2.0% or less, and further contains, as required, at least one of Cu: 0.01% or more and 1.0% or less, Ni: 0.01% or more and 0.5% or less, Mo: 0.01% or more and 0.5% or less, V: 0.001% or more and 0.030% or less, Nb: 0.001% or more and 0.030% or less, Ti: 0.001% or more an 0.020% or less, Mg: 0.005% or more and 0.1% or less, Zr: 0.005% or more and 0.1% or less, Ca: 0.0005% or more and 0.010% or less, and REM: 0.005% or more and 0.1% or less, and the remainder contains Fe and inevitable impurities. However, in a case where the rail has a component composition which further contains, in terms of mass %, C: 0.60% or more and 1.20% or less, Si: 0.05% or more and 2.00% or less, and Mn: 0.05% or more and 2.00% or less and in which the remainder contains Fe and the inevitable impurities, there decreases an improvement effect of surface layer hardness of the head portion 1*a* by the first cooling step to a second cooling step which will be described later. Consequently, in the rail of such a component constitution, application of the manufacturing method of the head hardened rail according to the present embodiment is unfavorable. It is to be noted that the inevitable impurities are various ores, scraps and the like which are included in a raw material of steel and are inevitably mixed in manufacturing steps of the steel.

Furthermore, an especially preferable component composition of the rail 1 is a composition which contains, in terms of mass %, C: 0.75% or more and 0.85% or less, Si: 0.5% or more and 1% or less, Mn: 0.5% or more and 1% or less, and Cr: 0.5% or more and 1% or less and the remainder comprising Fe and the inevitable impurities, or further contains V: 0.002% or more and 0.01% or less.

Hereinafter, reasons why this component composition is preferable will be described. It is to be noted that in the following description, a content [%] of each element means mass %.

In a case where a content of C is smaller than 0.75%, its effect deteriorates, and hence it is preferable that the C content is 0.75% or more. On the other hand, in a case where the C content is in excess of 0.85%, an amount of cementite increases with the increase of the C content, increase of hardness or strength can be expected, but conversely, ductility decreases. Furthermore, the increase of the C content enlarges a temperature range in which a steel structure is $\gamma+\theta$, and this leads to fostering of softening of a weld heat influencing portion. Consequently, it is preferable that the C content is 0.85% or less.

Si is useful for deoxidation in rail material refining, and strengthening of a pearlite structure, but in a case where an Si content is smaller than 0.5%, its effect decreases, and hence it is preferable that the Si content is 0.5% or more. On the other hand, in a case where the Si content is in excess of 1%, decarburization of the rail 1 is promoted, or generation of surface flaws of the rail 1 is promoted, and hence it is preferable that the Si content is 1% or less.

Mn has an operation of lowering a pearlite transformation temperature of steel and densifying pearlite lamella spacing, and hence addition of Mn makes it easy to maintain high hardness into a rail inner region. In a case where an Mn content is smaller than 0.5%, its effect deteriorates, and hence it is preferable that the Mn content is 0.5% or more. On the other hand, in a case where the Mn content is in excess of 1%, an equilibrium transformation temperature (TE) of pearlite lowers, and martensite transformation easily occurs, and hence it is preferable that the Mn content is 1% or less.

Cr is an element that raises the equilibrium transformation temperature (TE) and contributes to fine pearlite lamella spacing, and hence addition of Cr has an effect of increasing the hardness and strength. Furthermore, the addition of Cr together with Sb is also effective for inhibition of generation of a decarburized layer. In a case where a Cr content is smaller than 0.5%, its effect deteriorates, and hence it is preferable that the Cr content is 0.5% or more. On the other hand, in a case where the Cr content is in excess of 1%, generation of welding defects increases, quenching properties increase, and generation of martensite is promoted, and hence it is preferable that the Cr content is 1% or less.

V is an element that forms VC, VN or the like to be finely deposited in ferrite, and contributes to high strength of steel through deposition strengthening of ferrite. Furthermore, this element also functions as a trap site of hydrogen, and has an operation of inhibiting delayed fractures of the rail 1, and hence the element can be contained. For the purpose of developing this operation, it is preferable to contain 0.002% or more of V. On the other hand, when the V content is in excess of 0.01%, the effect is saturated, but alloy cost noticeably increases, and hence in a case of containing V, it is preferable that the V content is 0.01% or less.

The rail 1 is conveyed into the heat treatment apparatus 2, and then the foot portion 1*b* of the rail 1 is sandwiched between the clamps 7*a* and 7*b* to fix the rail to the heat treatment apparatus 2.

Next, the cooling medium is squirted from the upper header 3, thereby starting the forcible cooling (the first cooling step). The surface temperature of the head portion 1*a* of the rail 1 at the start of the forcible cooling needs to be not less than the austenite range temperature, and is preferably 800° C. or more. The temperature at the start of the forcible cooling is not less than the austenite range temperature and is especially 800° C. or more, thereby making it possible to increase the surface layer hardness of the head portion 1*a*. That is, by adjusting the surface temperature at the start of the forcible cooling into 800° C. or more, it is possible to inhibit deposition of a soft ferrite phase and hold higher hardness. Furthermore, in the first cooling step, the rail 1 is cooled at a cooling rate of 10° C./sec or more until the surface temperature of the head portion 1*a* reaches 500° C. or more and 700° C. or less after the forcible cooling is started. Here, in the first cooling step, when the rail cools until the surface temperature of the head portion 1*a* is lower than 500° C., a structure other than pearlite, e.g., bainite or martensite is generated, and hence the hardness or toughness of the head portion 1*a* decreases.

In the first cooling step, the control section 8 calculates the cooling rate of the head portion 1*a* from the measurement result of the head portion thermometer 5, and stepwisely or continuously changes at least one of the amount of the cooling medium to be squirted, the squirt pressure, the temperature and the water content so that the cooling rate is 10° C./sec or more. In the first cooling step, when the cooling rate is 10° C./sec or more, the lamella spacing of the pearlite structure becomes fine, and hence the surface layer hardness of the head portion 1*a* can increase. Furthermore, it is preferable that the cooling rate at this time is 20° C./sec or more as long as a facility capability is sufficient, and it is further preferable that the cooling rate is 30° C./sec or more. The larger the cooling rate is, the finer the lamella spacing becomes. Therefore, the surface layer hardness increases. Furthermore, it is preferable that spray water or mist is used as the suitable cooling medium to obtain the cooling rate of 10° C./sec or more. It is to be noted that in the first cooling step, even when the cooling rate is inevitably lower than 10° C./sec, there are not any problems as long as an average cooling rate through the first cooling step is 10° C./sec or more.

After the first cooling step, the rail 1 is subjected to a soaking treatment so that the surface temperature of the head portion 1*a* becomes uniform (a soaking step). In the soaking step, the control section 8 adjusts the cooling rate into −5° C./sec or more and 5° C./sec or less. An adjusting method of the cooling rate is similar to that in the first cooling step. The minus in the cooling rate indicates a state where a quantity of heat to be generated with pearlite transformation is higher than a cooling ability by the cooling medium and hence heat rises. In the soaking step, the soaking treatment including slow cooling or heat rise is performed so that the cooling rate falls in the above range, whereby the pearlite transformation proceeds in the surface of the head portion 1*a*. Furthermore, also in the above range of the cooling rate, it is preferable that the cooling rate is −2° C./sec or more and 2° C./sec or less.

In the soaking step, the cooling rate is adjusted into the above range, whereby a surface layer structure of the head portion 1*a* can be formed into the pearlite structure having high hardness. It is to be noted that when the first cooling step shifts to the soaking step, a state where the cooling rate gradually decreases may inevitably occur. However, it is preferable that the surface temperature does not lower below 500° C. during the soaking.

Furthermore, it is preferable that the soaking step is performed until the pearlite transformation of the head portion 1*a* of the rail 1 finishes. Here, the end of the pearlite transformation becomes apparent as a rapid temperature fall. Consequently, by detecting this rapid temperature fall from the measurement result of the head portion thermometer 5, it is possible to detect the end of the pearlite transformation.

After the soaking step, the rail 1 is forcibly cooled until the head portion 1*a* reaches 20° C. or more and 450° C. or less (the second cooling step). A cooling stop temperature that is the surface temperature of the head portion 1*a* after the forcible cooling in this second cooling step is preferably 50° C. or more and further preferably 300° C. or more. In the second cooling step, the control section 8 adjusts the cooling rate into 1° C./sec or more and 15° C./sec or less. An adjusting method of the cooling rate is similar to that in the first cooling step. In the second cooling step, the cooling rate is adjusted into 1° C./sec or more and 15° C./sec or less and the cooling stop temperature is adjusted into 450° C. or less, so that the ductility of the rail 1 can improve. Furthermore, the cooling stop temperature in the second cooling step is adjusted into 20° C. or more, preferably 50° C. or more, and further preferably 300° C. or more, so that cracks after the cooling can be prevented and additionally, heat treatment time can be shortened. Furthermore, in the second cooling step, as a change amount of the surface temperature of the head portion 1*a* is larger, i.e., as the temperature at the cooling stop is lower, heat return can be prevented.

After the second cooling step, the fixed clamps 7*a* and 7*b* are released and the rail 1 is conveyed out from the heat treatment apparatus 2. Further, in a case where the temperature of the rail 1 conveyed outside is higher than ordinary temperature, the rail 1 is cooled down to ordinary temperature by performing radiation cooling until the temperature becomes about the ordinary temperature in a facility, e.g., a cooling bed or the like as required.

Through the above-mentioned steps, it is possible to manufacture a pearlite-based head hardened rail which is excellent in surface hardness and toughness and to which various binary alloy elements are added.

It is to be noted that in the manufacturing method of the head hardened rail according to the one embodiment of the present invention, the foot portion 1*b* of the rail 1 is cooled by the cooling medium squirted from the lower header 4. The foot portion 1*b* is cooled while performing the first cooling step to the second cooling step. In this case, the foot portion may finally reach about the same temperature as in the head portion 1*a* when the second cooling step ends, and a cooling pattern usually for use may be applied to a cooling pattern of the foot portion 1*b*. Furthermore, the cooling may be performed so that a temperature hysteresis becomes similar to that of the head portion 1*a*. It is to be noted that when adjusting the cooling rate of the underside of foot 1*g*, the measurement result of the foot portion thermometer 6 is used in the same manner as in the first cooling step to the second cooling step. Furthermore, the web portion 1*c* of the rail 1 is indirectly cooled by cooling the head portion 1*a* and the foot portion 1*b*.

<Modification>

Hitherto, the preferable embodiments of the present invention have been described in detail with reference to the accompanying drawing, but the present invention is not limited to such examples. It is apparent that a person who has ordinary knowledge in a field of a technology to which the present invention belongs can perceive various changes or modifications within the scope of the technical thoughts described in claims, and it should be understood that needless to say, these changes or modifications also belong to the technical scope of the present invention.

For example, in the above embodiment, it has been described that when adjusting the cooling rate, the control section 8 changes at least one of the amount of the cooling medium to be squirted, the squirt pressure, the temperature and the water content by use of the measurement result of the head portion thermometer 5, but the present invention is not limited to such an example. For example, the control section 8 may beforehand adjust the cooling rate by use of a program to stepwisely or intermittently change at least one of an amount of a cooling medium to be squirted from the upper header 3, a squirt pressure thereof, a temperature thereof and a water content thereof for each of the first cooling step to the second cooling step, by learning of actual cooling results.

Furthermore, in the above embodiment, it has been described that the end of the pearlite transformation is detected by using the head portion thermometer 5 in the soaking step, but the present invention is not limited to this example. For example, by performing preliminary cooling in advance, time from the start of the cooling to completion of the transformation may be determined, and the soaking step may end in accordance with the determined time. Furthermore, the soaking step may end in accordance with time until the end of the pearlite transformation which is presumed by heat transfer simulation or the like.

Furthermore, a plurality of head portion thermometers 5 and a plurality of foot portion thermometers 6 may be disposed. In this case, different regions of a head top face and different regions of an underside of foot are measured with the plurality of head portion thermometers 5 and the plurality of foot portion thermometers 6, respectively, and an average value of the measurement results, or the like may be calculated as each of surface temperatures of the head top face and the underside of foot.

Furthermore, the heat treatment apparatus 2 may have an oscillation mechanism to perform oscillation in the longitudinal direction of the rail 1, in the upper header 3 and the lower header 4 or at least one of the clamps 7*a* and 7*b*. In at least one step in the first cooling step to the second cooling step, the oscillation mechanism oscillates the upper header 3 and the lower header 4 or the at least one of the clamps 7*a* and 7*b*. Consequently, a region to squirt the cooling medium to the rail 1 relatively moves, so that it is possible to more uniformly cool the rail 1.

Furthermore, it has been described that the heat treatment apparatus 2 has the upper header 3 and the lower header 4 as means for cooling the rail 1, but the present invention is not limited to this example. For example, the heat treatment apparatus 2 may further have a middle header to cool the web portion 1*c* as required. The middle header has a constitution similar to those of the upper header 3 and the lower header 4, and is constituted so that the cooling medium squirted from nozzles of the middle header hits the web portion 1*c*.

Furthermore, in the above embodiment, it has been described that in the second cooling step, the forcible cooling is performed until the temperature reaches 20° C. or more and 450° C. or less, but the present invention is not limited to this example. In the second cooling step, the rail 1 may be cooled by the radiation cooling, not the forcible cooling. It is to be noted that in the second cooling step, the forcible cooling is performed, whereby there is the advantage that inner hardness increases as compared with a case where the rail 1 is cooled by the radiation cooling.

<Effect of Embodiment of Present Invention>

Effects of the embodiment of the present invention will now be described.

(1) A manufacturing method of a head hardened rail according to the embodiment of the present invention includes, when forcibly cooling at least a head portion of a hot-rolled high-temperature rail 1 or a heated high-temperature rail 1, starting the forcible cooling from a state where a surface temperature of the head portion 1*a* of the rail 1 is not less than an austenite range temperature, and performing the forcible cooling at a cooling rate of 10° C./sec or more until the surface temperature of the head portion 1*a* reaches 500° C. or more and 700° C. or less after the forcible cooling is started (the first cooling step).

According to the above constitution, the cooling is rapidly performed from the state of the temperature that is not less than the austenite range temperature to a temperature range in which pearlite transformation occurs, whereby lamella spacing of a pearlite structure becomes fine. Consequently, also in a case where various alloy elements are added, it is possible to manufacture the head hardened rail in which the surface layer of the head portion 1*a* is excellent in hardness and toughness. Furthermore, according to the above constitution, as in the method described in PTL 2, it is possible to obtain an effect of improving productivity and an effect of decreasing an energy consumption rate as compared with a cooling pattern to repeat cooling and heating.

(2) The method includes adjusting the surface temperature of the head portion 1*a* at the start of the forcible cooling into 800° C. or more.

According to the above constitution, it is possible to manufacture the head hardened rail excellent in hardness and toughness.

(3) The method includes performing the forcible cooling at the cooling rate of 10° C./sec or more until the surface temperature of the head portion 1*a* reaches 500° C. or more and 700° C. or less after the forcible cooling is started, and then cooling the head portion 1*a* at a cooling rate of −5° C./sec or more and 5° C./sec or less until pearlite transformation finishes (a soaking step).

According to the above constitution, the surface layer structure of the whole head portion 1*a* can be formed into the pearlite structure. Consequently, even in a case where various alloy elements are added, it is possible to manufacture the head hardened rail in which the surface layer of the head portion 1*a* is excellent in hardness and toughness.

(4) The method includes performing the forcible cooling at a cooling rate of −5° C./sec or more and 5° C./sec or less until pearlite transformation finishes, and then performing the forcible cooling at a cooling rate of 15° C./sec or less until the surface temperature reaches 450° C. or less.

According to the above constitution, it is possible to improve the ductility of the rail.

(5) The rail 1 includes steel of a composition which contains, in terms of mass %, C: 0.75% or more and 0.85% or less, Si: 0.5% or more and 1% or less, Mn: 0.5% or more and 1% or less, Cr: 0.5% or more and 1% or less and V: 0% or more and 0.01% or less, and in which the remainder contains Fe and inevitable impurities.

According to the above constitution, it is possible to obtain a pearlite rail excellent in hardness, ductility and welding properties under heat treatment conditions of (1) to (3).

(6) The rail 1 includes the steel containing V: 0.002% or more and 0.01% or less.

According to the above constitution, it is further possible to prevent delayed fractures due to remaining of hydrogen.

(7) A manufacturing apparatus of a head hardened rail according to an embodiment of the present invention has cooling means 3 for forcibly cooling at least a head portion 1*a* of a rail 1, and a control section 8 to control the cooling means 3, and the control section 8 starts the forcible cooling from a state where a surface temperature of the head portion 1*a* of the rail 1 is not less than an austenite range temperature, and performs the forcible cooling at a cooling rate of 10° C./sec or more until the surface temperature reaches 500° C. or more and 700° C. or less after the forcible cooling is started.

According to the above constitution, it is possible to obtain an effect similar to that of (1).

EXAMPLES

Next, examples performed by the present inventors will be described.

In examples, similarly to the above embodiment, a longitudinal rail 1 hot-rolled at 900° C. was forcibly cooled by using a heat treatment apparatus 2, and afterward, a surface structure and hardness were checked. In the rail 1, there was used steel which contained C: 0.75% or more and 0.85% or less, Si: 0.5% or more and 1% or less, Mn: 0.5% or more and 1% or less, Cr: 0.5% or more and 1% or less and V: 0.002% or more and 0.01% or less, and in which the remainder included Fe and inevitable impurities. It is to be noted that the above component range indicates variation of components in a plurality of examples and comparative examples which will be described later.

First, the longitudinal rail 1 hot-rolled at 900° C. was conveyed into the heat treatment apparatus 2, and a foot portion 1*b* of the rail 1 was fixed with clamps 7*a* and 7*b*.

Next, a first cooling step to a second cooling step were performed and the rail 1 was forcibly cooled. In a cooling medium, air was used in a range in which an absolute value of a cooling rate was smaller than 10° C./sec, and mist was used in a range in which the absolute value of the cooling rate was 10° C./sec or more. Furthermore, from the measurement result of a head portion thermometer 5, a jet pressure in the case where the cooling medium was the air or a content of water to be thrown inside (an air/water ratio) in a case where the cooling medium was the mist was adjusted into a target temperature hysteresis, thereby adjusting the cooling rate. Furthermore, a timing of end of a soaking step was adjusted into a timing at which the cooling rate rapidly increased from the measurement result of the head portion thermometer 5.

Furthermore, the rail 1 was taken out from the heat treatment apparatus 2 and natural radiation cooling was further performed until the rail reached ordinary temperature, to manufacture a head hardened rail. Afterward, a surface layer structure of a whole head portion 1*a* was observed with SEM, and hardness of the surface layer of the head portion 1*a* was measured by a surface Brinell hardness test.

Furthermore, as comparative examples, steps were similarly carried out also on conditions that one of a surface temperature at start of forcible cooling, a cooling rate in a first cooling step, a surface temperature at end of the first cooling step and a cooling rate in a soaking step deviated from the above range of the embodiment, and a surface structure and hardness of an obtained head hardened rail were checked.

Table 1 illustrates manufacturing conditions, observation results of surface layer structures and measurement results of surface layer hardness of Examples 1 to 4 and Comparative Examples 1 to 5. In Examples 1 to 4, manufacturing was carried out on conditions that a surface temperature of a head portion 1*a* at start of forcible cooling was 730° C. or more and was not less than an austenite range temperature, a cooling rate in a first cooling step was 10° C./sec or more, a target soaking temperature that was a target surface temperature of the head portion 1*a* at end of the first cooling step was 500° C. or more, and a cooling rate range in a soaking step was −5° C./sec or more and 5° C./or less. Additionally, in Examples 1 to 4 and Comparative Examples 1 to 5, the surface temperature of the head portion 1*a* at the end of the first cooling step, i.e., at start of the soaking step was the same temperature as the target soaking temperature.

On the other hand, in Comparative Example 1, a surface temperature of a head portion 1*a* at a start of a first cooling step was 700° C., that was not more than an austenite range temperature, and a head hardened rail was manufactured on conditions that the surface temperature at start of forcible cooling was lower than that of the above embodiment. In Comparative Example 2, a head hardened rail was manufactured on conditions that a target surface temperature of a head portion 1*a* when ending a first cooling step was 720° C. and a surface temperature at the end of the first cooling step was higher than that of the above embodiment. In Comparative Example 3, a head hardened rail was manufactured on conditions that a target surface temperature of a head portion 1*a* when ending a first cooling step was 450° C. and a surface temperature at the end of the first cooling step was lower than that of the above embodiment. In Comparative Example 4, a head hardened rail was manufactured on conditions that a cooling rate in a first cooling step was 5° C./sec and the cooling rate was lower than that of the above embodiment. In Comparative Example 5, a head hardened rail was manufactured on conditions that a cooling rate in a soaking step was −8° C./sec or more and 8° C./sec or less, and the conditions had a broad range deviating from the ranges of Examples 1 to 4. Additionally, manufacturing conditions other than the above conditions in Comparative Examples 1 to 5 were in a range similar to that of the examples.

TABLE 1

| | Forcible cooling start temp. (° C.) | Target soaking temp. (° C.) | Ave. cooling rate in first cooling step (° C./sec) | Cooling rate range in soaking step (° C./sec) | Surface temp. after second cooling step (° C.) | Ave. cooling rate in second cooling step (° C.) | Surface layer structure | Surface layer hardness (HB) |
|---|---|---|---|---|---|---|---|---|
| Example 1 | 730 | 700 | 10 | −5~5 | 450 | 5 | Pearlite | 380 |
| Example 2 | 730 | 550 | 10 | −5~5 | 450 | 5 | Pearlite | 390 |
| Example 3 | 800 | 530 | 20 | −3~3 | 350 | 10 | Pearlite | 395 |
| Example 4 | 820 | 500 | 30 | −2~2 | 300 | 15 | Pearlite | 400 |
| Comparative Example 1 | 700 | 550 | 10 | −5~5 | 450 | 5 | Pearlite | 320 |
| Comparative Example 2 | 820 | 720 | 10 | −5~5 | 300 | 15 | Pearlite | 330 |
| Comparative Example 3 | 820 | 450 | 30 | −2~2 | 300 | 15 | Bainite | 300 |
| Comparative Example 4 | 730 | 550 | 5 | −5~5 | 450 | 5 | Pearlite | 350 |
| Comparative Example 5 | 730 | 550 | 10 | −8~8 | 450 | 5 | Pearlite | 310 |

As the observation results of the surface layer structure, in the head hardened rails of Examples 1 to 4, it was confirmed that the surface layer structure of the whole head portion 1*a* was a 100% pearlite structure more excellent in toughness as compared with a martensite structure. Furthermore, as the measurement results of the surface layer hardness, in the head hardened rails of Examples 1 to 4, it was confirmed that desired hardness of HB380 or more was obtainable. On the other hand, in the head hardened rails of Comparative Examples 1, 2, 4 and 5, it was confirmed that the surface layer structure was the pearlite structure, but the surface hardness of each rail was smaller than HB380, and desired hardness was not obtainable. Furthermore, in the head hardened rail of Comparative Example 3, the surface layer structure was a bainite structure, the desired pearlite structure was not obtainable, and hardness was also smaller than HB380.

From the above results, according to the manufacturing method of the head hardened rail according to the present invention, it can be confirmed that it is possible to manufacture a pearlite-based head hardened rail which is excellent in surface hardness and toughness and to which various alloy elements are added.

Furthermore, the present inventors checked influences of a cooling rate and a cooling stop temperature in the second cooling step on inner hardness of the head portion 1*a* of the rail 1 and ductility of the rail 1. In this check, a forcible cooling start temperature, a target soaking temperature and an average cooling rate in the first cooling step were the same conditions as those of Example 2 in Table 1, and a surface temperature (the cooling stop temperature) after the second cooling step and an average cooling rate were set to conditions illustrated in Table 2. Furthermore, as to the obtained rail 1, hardness (the inner hardness) at a head top diagonal central position was measured, and from the head top diagonal central position a round bar form tensile test piece sampled so that a tensile direction became a rail longitudinal direction, and then an elongation (a total elongation EI) was checked. Table 2 illustrates the check results of the inner hardness and elongation.

TABLE 2

| | Surface temp. after second cooling step (cooling stop temp.) (° C.) | Ave. cooling rate in second cooling step (° C./sec) | Surface layer structure | Surface layer hardness (HB) | Inner hardness (HB) | Elongation (%) |
|---|---|---|---|---|---|---|
| Example 2 | 450 | 5 | Pearlite | 390 | 320 | 15 |
| Example 5 | 450 | 15 | Pearlite | 390 | 330 | 14 |
| Example 6 | 400 | 5 | Pearlite | 390 | 330 | 14 |
| Example 7 | 300 | 5 | Pearlite | 390 | 350 | 13 |
| Example 8 | 300 | 1 | Pearlite | 390 | 310 | 18 |
| Example 9 | 450 | 20 | Pearlite | 390 | 360 | 8 |
| Example 10 | 20 | 15 | Pearlite | 390 | 335 | 14 |
| Example 11 | 470 | 15 | Pearlite | 390 | 355 | 9 |
| Example 12 | 50 | 15 | Pearlite | 390 | 330 | 14 |

In each of Examples 2 and 5 to 11, the surface layer hardness indicated a high value. Further, Example 2 and Examples 5 to 8 and 12 in which the cooling stop temperature of the second cooling step was 50° C. or more and 450° C. or less and the average cooling rate in the second cooling step was 15° C./sec or less satisfied an inner hardness of HB310 or more and an elongation of 13% or more. On the other hand, in Example 9 in which the average cooling rate of the second cooling step was in excess of 15° C./sec and Example 11 in which the cooling stop temperature of the second cooling step was in excess of 450° C., elongations were 8% and 9%, respectively. From these results, it was possible to confirm that the conditions of Examples 2 and 5 to 8 were excellent from the viewpoint of the ductility of the rail 1. Furthermore, in Example 10 in which the cooling stop temperature of the second cooling step was lower than 50° C., there were not any problems immediately after cooling, but among experiment samples in storage, there was the sample in which cracks supposedly due to remaining of hydrogen were generated.

From the above-mentioned results, it can be confirmed that when the cooling rate of the second cooling step is 15° C./sec or less and the cooling stop temperature is 20° C. or more, preferably 50° C. or more, and further preferably 300° C. or more and in a range of 450° C. or less, it is possible to acquire ductility of the rail 1.

REFERENCE SIGNS LIST

1: rail
1*a*: head portion
1*b*: foot portion
1*c*: web portion
1*d*: head top face
1*e* and 1*f*: head side face
1*g*: underside of foot
2: heat treatment apparatus
3, 3*a*, 3*b* and 3*c*: upper header
4: lower header
5: head portion thermometer
6: foot portion thermometer
7*a* and 7*b*: clamp
8: control section

The invention claimed is:

1. A manufacturing method of a head hardened rail, the method comprising:

forcibly cooling at least a head portion of a hot-rolled high-temperature rail or a heated high-temperature rail;

starting the forcible cooling from a state where a surface temperature of the head portion of the rail is not less than an austenite range temperature; and performing the forcible cooling at a cooling rate of 10° C./sec or more until the surface temperature reaches 500° C. or more and 700° C. or less after the forcible cooling is started, adjusting the surface temperature at the start of the forcible cooling to be 800° C. or more, after performing the forcible cooling, then cooling the head portion at a cooling rate of −5° C./sec or more and 5° C./sec or less until a pearlite transformation finishes, wherein the rail comprises steel having a chemical composition comprising, by mass %, C: 0.15% or more and 0.85% or less, Si: 0.5% or more and 1% or less, Mn: 0.5% or more and 1% or less, Cr: 0.5% or more and 1% or less and V: 0% or more and 0.01% or less, and a remainder comprising Fe and inevitable impurities.

2. The manufacturing method of the head hardened rail according to claim 1, further comprising performing forcible cooling at a cooling rate of −5° C./sec or more and 5° C./sec or less until the pearlite transformation finishes, and then performing the-forcible cooling at a cooling rate of 1° C./sec or more and 15° C./sec or less until the surface temperature reaches 50° C. or more and 450° C. or less.

3. The manufacturing method of the head hardened rail according to claim 1, wherein the chemical composition comprises, by mass %, V: 0.002% or more and less than 0.01%.

4. The manufacturing method of the head hardened rail according to claim 1, further comprising, after cooling the head portion, then performing the-forcible cooling at a cooling rate of 1° C./sec or more and 15° C./sec or less until the surface temperature reaches 50° C. or more and 450° C. or less.

5. The manufacturing method of the head hardened rail according to claim 1, wherein the chemical composition comprises, by mass %, C: 0.75% or more and less than 0.85%, and V: 0% or more and less than 0.01%.

* * * * *